United States Patent [19]

Caulkins

[11] 3,951,503

[45] Apr. 20, 1976

[54] CABLE SPLICE ASSEMBLY FOR MULTICONDUCTOR CABLES

[76] Inventor: Robert M. Caulkins, 2664 Glenbar Court, Columbus, Ohio 43219

[22] Filed: Nov. 4, 1974

[21] Appl. No.: 520,633

[52] U.S. Cl. ..... 339/100; 174/88 R; 174/91

[51] Int. Cl.[2] ..... H01R 7/04

[58] Field of Search ..... 339/100, 268 R, 268 S; 174/88 R, 91

[56] References Cited

UNITED STATES PATENTS

| | | | |
|---|---|---|---|
| 916,313 | 3/1909 | Herrington | 339/100 |
| 1,845,629 | 2/1932 | Saylor | 174/88 R X |
| 2,896,186 | 7/1959 | Hardmark | 339/100 |
| 3,083,350 | 3/1963 | Mitthauer et al. | 339/100 |
| 3,317,883 | 5/1967 | Gourley et al. | 339/100 X |
| 3,441,658 | 4/1969 | Stark et al. | 174/88 R |
| 3,786,173 | 1/1974 | Vogt | 339/100 X |

FOREIGN PATENTS OR APPLICATIONS

| | | | |
|---|---|---|---|
| 612,213 | 11/1948 | United Kingdom | 339/100 |
| 232,334 | 4/1925 | United Kingdom | 339/100 |

*Primary Examiner*—Joseph H. McGlynn
*Assistant Examiner*—Howard N. Goldberg
*Attorney, Agent, or Firm*—Cennamo; Kremblas; Foster

[57] ABSTRACT

A cable splicing apparatus for multiconductor cables which is characterized by a sleeve portion having resilient end portions adapted to receive threaded collar means for securely frictionally gripping the ends of the cable being spliced. The apparatus further includes a novel slideably mounted centerplate integrally carrying electrically conducting pins for connecting the severed conductors to form the splice. The centerplate is adapted to cooperate with guide means to assure positive alignment with the cable and the sleeve to simplify installation and to eliminate improper connections between non-mating conductors. Preferably, after the splice connection has been made and the sleeve is secured, a heat responsive plastic tube is employed to completely shroud the splice joint.

6 Claims, 3 Drawing Figures

CABLE SPLICE ASSEMBLY FOR MULTICONDUCTOR CABLES

BACKGROUND

The prior art in cable splicing apparatus is relatively old, however, most structures rely on a crimping principal and relatively complex and cumbersome installation techniques. Others, primarily concerned with single conductors employ a maze type securing feature wherein the cable is locked into position by multiple complex turns through appropriate pathways. Examples of prior art types splicing constructions for multiconductor cables are represented by U.S. Pat. No. 2,896,186 and 3,786,173.

However, these last mentioned forms of cable splices are totally impractical for heavy duty, industrial multiconductors cables, such as used in the mining industry for example. For this reason, most present commercial splicing applications for this type of cable rely on a crimping and soldering techniques as the only practical and useful manner of repairing damaged cables.

This is emphasized by the fact that the crimping technique is not totally satisfactory for several reasons. Firstly, the conductors are inherently weakened at the point of the crimp by the crushing action which also creates heat build-up areas in the conductor. This often leads to subsequent failure of the splice in a rather short time. Secondly, the repair and installation procedure is time-consuming and costly. Thirdly, the present crimping type splice requires the removal of the entire cable from the industrial site which lengthens down time and further increases the overall-costs and dissatisfaction with the prior art techniques.

However, prior to the present invention, the use of the other means to adequately secure the cable and insure appropriate conductor connection in a simple and satisfactory design represents a long-standing unsolved problem in the commercial cable splicing art.

SUMMARY OF INVENTION

The present invention relates to a multiconductor splicing construction which does not employ a crimping principle and which can be installed on the job site in a relatively short time. The invention comprises a tubular sleeve or housing provided with resilient, threaded end portions. A securing collar is adapted to receive each end to provide secure frictional engagement of the sleeve with the outer surface of the cable portions being joined.

A centerplate provided with a plurality of conductor pins for electrical connection with the severed ends of the respective conductors is slideably mounted in the housing. The opposing sides of the centerplate are provided with a face plate including pin guides in the form of sharp-edged shrouds which may be easily embedded in the insulating material surrounding the conductors. This assures positive alignment between mating conductor ends and the conductor pins and simplifies installation of the splice.

OBJECTS

It is a primary object of the present invention to provide an improved multiconductor cable splicing apparatus which is durable, reliable and easily installed.

It is another object of the present invention to provide an apparatus of the type described which includes a novel, slideably mounted center plate provided with integrally formed conductor pins for reliably making electrical connection with the respective cable conductors.

It is another object of the present invention to provide an apparatus of the type described which includes guide means and key means associated with the novel center plate for positive alignment of the respective conductor pins and each conductor connected therewith.

It is a further object of the present invention to provide an apparatus of the type described which permits installation and repair of the cable on the job site and which requires only standard tools and relatively simple and easy manipulation of the cable to be repaired.

It is still another object of the present invention to provide an apparatus of the type described which permits exceptionally rapid cable splice repair at minimum expense and minimum shut-down time as compared to prior art methods and means.

It is yet a further object of the present invention to provide an apparatus of the type described which incorporates the above mentioned advantages and also eliminates weakening the cable conductors and avoids the introduction of heat build-ups areas in the repaired conductors.

IN THE DRAWINGS

DETAILED DESCRIPTION

Figure 1:
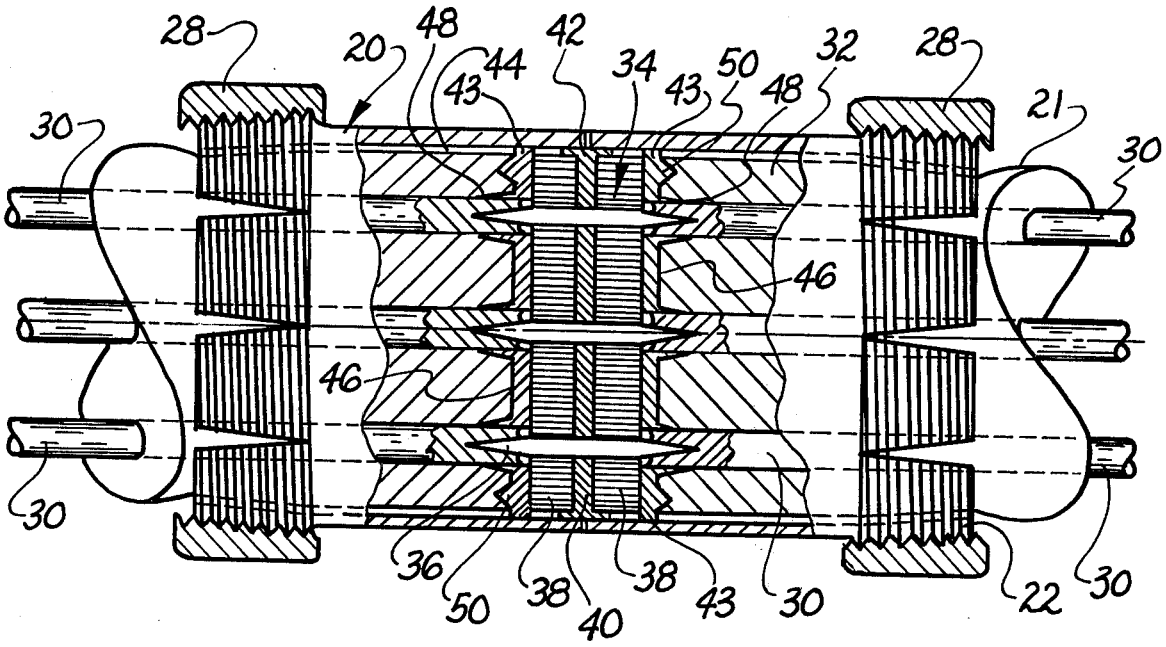
FIG. 1 is a side elevational view in partial section of a cable splice assembly constructed in accordance with the present invention, the section being taken along the centerline of the assembly.
Figure 2:
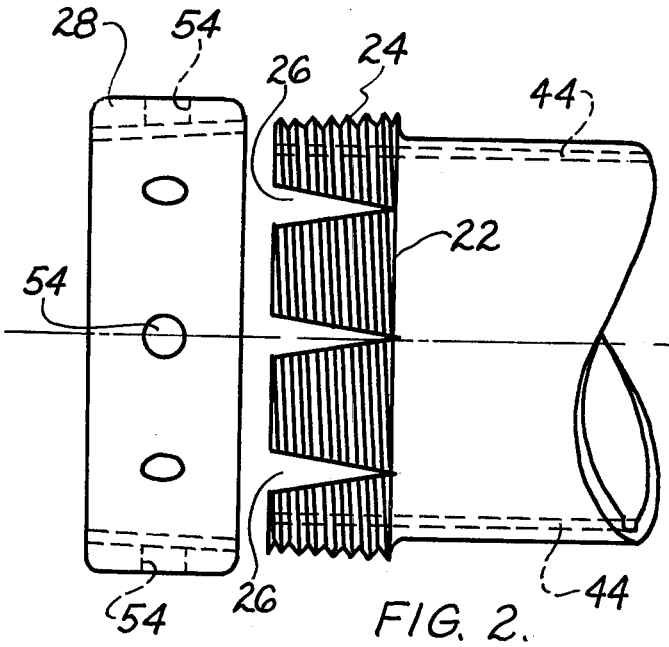
FIG. 2 is a partial side elevational view of a portion of the assembly shown in FIG. 1 illustrating an end portion of the housing with the collar means removed therefrom.
Figure 3:
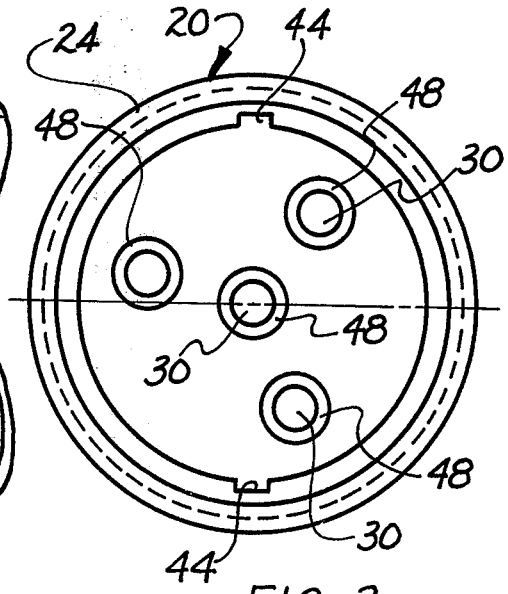
FIG. 3 is an end elevational view of the sleeve assembly and a three conductor cable prior to positioning of the centerplate and guide means of the present invention.

Referring in detail to the drawings, a cable splice assembly for multiconductor cables constructed in accordance with the present invention is illustrated in FIG. 1, and includes a tubular sleeve or housing, indicated generally at 20 which is adapted to slidably receive a multiconductor cable indicated generally at 21. The end portions 22 of sleeve 20 are provided with an outer surface having tapered threaded portions 24 with the thread diameter increasing in the direction toward the center of sleeve 20. End portions 22 are also resilient and include a plurality of spaced slots 26 which permit the diameter of the end portions to be substantially reduced upon applying radial inward force to the outer surface thereof.

Each end portion 22 is adapted to receive a collar 28 which is provided with an inner tapered and threaded surface which is designed to appropriately mate with the threaded surface 24 on end portions 22. Threading the collars 28 on the end portions 22 substantially reduces the inner diameter of each end portion to provide secure frictional engagement with the outer surface covering of cable 21.

Cable 21 is represented as a typical heavy duty, three conductor commercial cable including a fourth ground cable of the type wherein the interior of the cable between the conductors and the ground is completely filled with solid insulating material. The conductors are referenced by numeral 30 and the insulating material by numeral 32.

In accordance with the present invention a centerplate indicated generally at 34 and of the same configuration as the cable 21 is provided which comprises a plurality of outwardly extending, electrically conducting pins or prongs 36. The number and location of pins 36 being equal to the number of conductors including the ground of the particular cable.

Centerplate 34 preferably is formed of an insulating material such as plastic or if a non-insulating material is used, that material is coated with a non-conducting material. In the embodiment shown in FIG. 1, pins 36 are rigidly disposed in a molded plastic material in a laminated construction having outer layers 38 and an inner layer 40. However, the centerplate 34 may also be a single piece of molded plastic as well without departing from the spirit of the present invention.

A pair of key means 42 are provided on the outer periphery of centerplate 34 which are adapted to mate with longitudinal slots or grooves 44 provided in the interior surface of sleeve 20. The function of the key and groove will be described later herein.

Also included is a pair of guide plates 46 which are slideably mounted in sleeve 20 and are disposed in engaging relationship to opposite faces of centerplate 34. The guide plates are composed of an insulating material, preferably a hard durable plastic. Preferably, guide plates 46 also include key means 43 which function similarly to the key means 42.

The outer face of each guide plate 46 includes a plurality of integrally formed shrouds 48 which are disposed in alignment with a respective pin 36. Preferably, the circular shaped shrouds 48 are provided with a relatively thin outer edge which may be easily embedded in the insulating material immediately surrounding each conductor 30.

Pins 36 have sufficient length to permit the outer ends of the pins to extend outwardly of the shrouds. Additionally, near the outermost edge of the guide plates 46, a sharp edged rim 50 is preferably provided which promotes more secure mounting of the guide plates to the respective cable ends to be spliced, as will be described in more detail later herein.

In operation, one would employ the following procedure to install the assembly of the present invention to provide a secure, dependable splice to a damaged multiconductor cables. For the purposes of illustration, the following description will be made relative to a typical heavy-duty, commercial, multiconductor cable such as frequently used in underground mine operations. Such cables are frequently 4 to 6 inches in diameter and are usually several hundred or even several thousand feet long and therefore represents a great amount of total weight. The cables are usually deployed along the length of a mine shaft to the working area of the shaft.

To repair such a cable, the cable is cut apart at the damaged area, with appropriate care taken that the cut is made as close as possible to a 90° angle relative to the length of the cable to provide "square" cable ends for the splice.

First a collar 28 and then sleeve 20 is slideably mounted on one end of the cut cable and the other collar 28 is similarly mounted over the other cable end. The sleeve and the collars, preliminarily are moved away from the ends of the cut cable to expose each of the cut ends and the respective conductors.

Then one guide plate 46 is mounted to one end of the cut cable with the shrouds 48 aligned with each respective conductor 30 and with the ground conductor. The guide plate may be readily installed and aligned as the cable size and configuration is standard and the guide plate is manufactured in accordance therewith. A relatively light tapping with a hammer-like tool would be sufficient to firmly embed the sharp outer rim 50 and the sharp edges of the shrouds in the insulating material 32. The length of the shrouds 48 need not be more than approximately one-half inch and may be as short as one-quarter inch to assure appropriate placement. However, other dimensions may be used as necessary for any given application to assure relatively secure positioning of the guide plates 46.

Preferably, the face of each guide plate which abuts against centerplate 34 is color coded such as by a circular design around the opening aligned with a respective shroud 48. This will tend to assure appropriate positioning of the two cable ends relative to the respective conductors to be joined upon completion of the splice.

The other guide plate 46 is installed on the opposing cable end in a like manner. The likelihood of crossing conductors is minimized by the use of color codes as suggested above and by the fact that the long lengths of commercial heavy duty cables normal encountered are not easily manually rotated or to any great degree twisted. Proper alignment of the respective conductor ends may therefore be a relatively simple matter although recognized as an absolute necessity for successful repair.

After the guide plates 46 are positioned, the centerplate 34 is mounted to one end of the cut cable. Preferably, centerplate 34 is mounted to the cable end over which the sleeve 20 has been first mounted, however, this is simply a matter of choice.

The recommended procedure is to mount the centerplate firmly against the guide plate 46 mounted on the same cable end carrying sleeve 20 in a similar manner as the guide plates were mounted. If both the guide plates and the centerplate include the keying feature shown in the described embodiment, it is of course necessary to angularly align the centerplate 34 to assure that key means 42 and 43 are in proper alignment. It is, of course, desirable to assure that the respective outwardly extending end points of pins 36 extend sufficiently through the shrouds 48 to make a second electrical engagement with the respective conductors a certainity.

Once the centerplate 34 is properly mounted on the cable end, sleeve 20 is slideably moved toward the cable end now carrying the centerplate 34 with the groove 44 aligned with the key means 42 and 43 on the centerplate and guide plate respectively. The sleeve is positioned far enough over the centerplate to provide for receiving the other end of the cable. Preferably, the centerplate is disposed approximately in the middle of the sleeve, but exact longitudinal centering is not critical.

When the sleeve is so positioned as described above, the collar 28 on the same portion of the cable as the sleeve 20 was disposed is brought into contact with the corresponding sleeve end and threaded onto the sleeve to secure that end of the sleeve to that portion of cable 21.

Preferably, collar 28 is provided with appropriate recesses, such as at 54, for a standard spanner wrench to be employed to more easily tighten the collar 28 on the sleeve to effectively reduce the inner diameter of the resilient end portion and assure secure frictional gripping of that portion of the cable retained in the threaded sleeve end portion.

The next step is to slideably position the opposite cable end carrying the other guide plate 46 into the sleeve 20 and make contact between the pins 36 facing in that direction with the appropriate conductors. In the same manner as described above, the shrouds 48 of the guide plate 46 are aligning the respective conductors which the shrouds 48 surround. The use of the color code and key means 43 assures that proper alignment is easily accomplished.

The engagement of the pins with the conductor ends is then made by manual pressure or preferably by the use of a hammer-like tool. One manner of assuring good electrical contact is by merely holding down the loose end of the cable manually inserted into contact with the pins 36 and firmly tapping the collar 28 which has been tightened on the opposing end of sleeve 20 to securely grip that cable portion. This engagement is relatively easy to obtain since good contact may be assured when pins 36 are embedded one-eighth to one-quarter inch into the conductors 30.

Once the opposite end of cable 21 is firmly positioned in the sleeve housing 20, the other collar 28 is similarly positioned to secure the relative position of the two ends of cable 21 so spliced and the cable is firmly joined and the splice is complete.

It should be pointed out herein, that while it is believed desirable to key the guide plates 46 and the centerplate for positive alignment, to key only the guide plates 46 effectively accomplishes the same purpose of angular alignment once the centerplate is mounted to the guide plate.

Further, it should be understood that one of the guide plates 46 could easily be integrally combined with one face of centerplate 34 without departing from the spirit of the present invention. Nor would such a construction significantly alter the installation procedure described herein, except for the simultaneous mounting of one of the guide plates and the centerplate to one of the cables being spliced as compared to the two-step procedure described herein.

Preferably, the sleeve 20 may then be further encased in a commercially available plastic shroud, such as provided by AMP, Inc. under the name "Heat-Shrink". An appropriate length of tube-shaped material of this nature would have been positioned over one of the cable ends prior to the original positioning of the collars 28 and sleeve 20. Then after the completion of the splice joint as described herein, the piece of heat shrinkable material is positioned over the sleeve and with the application of heat, the splice assembly is fully covered by a water-proof barrier which also provides additional strength by joining the opposing cable ends along a short length of the cable on either side of sleeve 20.

It should also be noted, that under most circumstances, a damaged multiconductor cable may be spliced using the assembly of the present invention on the job site in as short a time as 20 minutes and no longer than approximately 30 minutes. The spliced cable is then ready to be put back into service immediately after repair.

In accordance with presently used techniques, the present invention totally obsoletes the removal of the entire cable from the job site and shipment of the cable to a repair site for welding and crimping operations to repair the damaged cable.

Furthermore, it should be noted that only relatively simple tools and procedures are required to provide the cable splice. The splice so completed in accordance herewith is, at least as dependable, and normally will be more dependable than the cumbersome, expensive, and time-consuming methods and means used prior to the present invention.

It should also be pointed out that conductor pins 36 preferably comprise a hardened metal alloy, for example, which possesses a lower resistance value as compared to the conductor metal, usually pure copper. One such suitable alloy would be an appropriate copper-silver alloy.

This feature has two advantages:

1. the hardened pins are more easily driven into the copper conductor to assure good electrical engagement;

2. the lower resistance value tends to substantially reduce subsequent failure caused by a heat build-up at the point of junction of the pins and the conductor.

Such heat build-up areas occur quite frequently using the crimping technique at points in the conductor which are severely deformed by the crushing action. The increased resistance resulting in the deformed conductor portions many times lead to subsequent failures in a relatively short time.

Also, the dimensions and taper of pins 36 may be suitably adapted to provide for minimum reduction of the resistance at the point of junction between the pins 36 and the conductors.

What is claimed is:

1. In a cable splice assembly for multiconductor cables, the combination of sleeve means adapted to slideably receive the portions of the cable being joined, said sleeve means provided with resilient end portions, each end portion having an outer, threaded surface; collar means threadably engaging a respective one of said resilient sleeve end portions for frictionally securing each sleeve end portion to a respective portion of cable on each side of the area being spliced; and a non-conducting centerplate slideably mounted in said sleeve means and including a plurality of electrically conducting pins longitudinally extending through opposing outer faces of said centerplate, a respective one of said pins being aligned to engage in electrically conducting relationship a respective one of each of the conductors in said cable being spliced.

2. The assembly defined in claim 1 including a pair of non-conducting guide plates slideably mounted in said sleeve means; a respective one of said guide plates being mounted in engagement with opposing faces of said centerplate, each of said guide plates including a plurality of outwardly extending hollow shrouds, each of said shrouds adapted to securely engage in surrounding relationship a respective end of each respective conductor to be spliced and aligned to receive a respective one of said conducting pins.

3. The assembly defined in claim 2 wherein said guide plates and said centerplate are keyed in said sleeve means against angular rotation.

4. The assembly defined in claim 2 wherein the inner surface of said sleeve includes a longitudinally extending guide slot and said guide plates include a key means slideably disposed in said guide slot to align said guide plates in predetermined angular position within said sleeve.

5. The assembly defined in claim 2 wherein the inner surface of said sleeve includes a longitudinally extending guide slot and said centerplate and said guide plates include key means slideably disposed in said guide slot to align said centerplate and guide plates in predetermined angular position within said sleeve.

6. In a cable splice assembly for multiconductor cables, the combination of sleeve means slideably mounted over the portions of the cable being joined, said sleeve means provided with resilient end portions provided with outer threaded surfaces; collar means threadably mounted on each of said resilient end portions and cooperating therewith to frictionally secure the portions of the cable carried in said sleeve; and a none-conducting centerplate of the same general configuration as said cable slideably mounted in said sleeve means and including a plurality of electrically conducting pins longitudinally extending through opposing outer faces of said centerplate, a respective one of said pins being aligned in electrically conducting engagement with a respective one of each of the conductors in said cable; and a non-conducting guide plate slideably disposed in said sleeve means and engaging each outer face of said centerplate and including a plurality of outwardly extending, hollow-shrouds, a respective one of said shrouds mounted in surrounding engagement with a respective one of said conductors and aligned to receive a respective one of said conducting pins, said guide plates being keyed in said sleeve means to align said centerplate and associated guide plates in coordinated angular position with said sleeve means.

* * * * *